US006767451B2

(12) United States Patent
Espeillac et al.

(10) Patent No.: US 6,767,451 B2
(45) Date of Patent: Jul. 27, 2004

(54) PROCEDURE AND DEVICE FOR CRACKING OF HYDROCARBONS USING TWO SUCCESSIVE REACTION CHAMBERS

(75) Inventors: Marcellin Espeillac, Versailles (FR); Pierre Crespin, Le Havre (FR)

(73) Assignee: Total Raffinage Distribution S.A., Puteaux (FR)

( * ) Notice: Subject to any disclaimer, the term of this patent is extended or adjusted under 35 U.S.C. 154(b) by 87 days.

(21) Appl. No.: 09/897,436

(22) Filed: Jul. 3, 2001

(65) Prior Publication Data

US 2002/0096452 A1 Jul. 25, 2002

(30) Foreign Application Priority Data

Jul. 5, 2000 (FR) ..... 00 08732

(51) Int. Cl.[7] ..... C10G 51/02

(52) U.S. Cl. ..... 208/74; 208/67; 208/72; 208/75; 208/76; 208/77; 208/78

(58) Field of Search ..... 208/67, 72, 74, 208/75, 76, 77, 78; 196/111

(56) References Cited

U.S. PATENT DOCUMENTS 2,488,713 A 11/1949 Delattre-Seguy ..... 196/49
3,437,584 A * 4/1969 Hamblin ..... 208/93
5,498,326 A * 3/1996 Galtier et al. ..... 208/74
5,582,711 A * 12/1996 Ellis et al. ..... 208/76
5,755,933 A * 5/1998 Ognisty et al. ..... 202/158
5,824,208 A * 10/1998 Bienstock et al. ..... 208/76
6,217,749 B1 * 4/2001 Espeillac et al. ..... 208/213

FOREIGN PATENT DOCUMENTS

EP 0 573 316 12/1993 ..... C10G/11/18
WO 98/12279 3/1998 ..... C10G/11/18

* cited by examiner

*Primary Examiner*—Walter D. Griffin
(74) *Attorney, Agent, or Firm*—Sughrue Mion, PLLC

(57) ABSTRACT

A process for cracking, in a fluidized bed, a hydrocarbon charge wherein the cooling particles, which may optionally also be catalytic particles, circulate in two successive reaction chambers (1; 16), in each of which they are brought into contact with at least one cut of hydrocarbons, and the reaction effluents from each of the chambers are directed towards one and the same fractionating unit. The effluents from each of the reaction chambers (1; 16) are fractionated in part separately in one and the same partially partitioned fractionating unit, and at least one cut (12) obtained by separately fractionating the effluents from one of the two reaction chambers (1; 16) is, as a whole or in part, reinjected into the other chamber.

21 Claims, 4 Drawing Sheets

PROCEDURE AND DEVICE FOR CRACKING OF HYDROCARBONS USING TWO SUCCESSIVE REACTION CHAMBERS

This present invention concerns the cracking of hydrocarbons in the presence of cooling particles, either catalytic or not, circulating in the fluidized phase. Another particular object of this present invention is a procedure for cracking [hydrocarbons] in a fluidized bed wherein the cooling particles circulate in two successive reaction chambers, in each of which they are put in contact with one or several cuts of hydrocarbons to be cracked.

This present invention furthermore relates to a device designed for the procedure in accordance with this present invention.

As known from prior art, the petroleum industry uses procedures for the conversion of heavy hydrocarbon charges wherein the hydrocarbon molecules with a high molecular weight and with a high boiling point are split up into smaller molecules that are capable of boiling at lower temperature ranges, depending on the desired application.

To effect this type of conversion, the petroleum industry uses, in particular, so-called fluid-state cracking procedures. In this type of procedures, the hydrocarbon charges, in generally pulverized in the form of small droplets, is put in contact with cooling particles at high temperature and which circulate in the reactor in the form of a fluidized bed, i.e., in a more or less dense suspension within a gaseous fluid which ensures or assists in its transport. In contact with the hot particles, the charge vaporizes, and the hydrocarbon molecules are cracked. The cracking reaction is a thermal reaction in case the particles only have a cooling function. The cracking reaction is catalytic by nature in case the cooling particles also have a catalytic function, i.e., they represent active sites promoting the cracking reaction, as is the case, in particular, in the so-called fluid-state catalytic cracking process (commonly referred to as FCC process, based on the English "Fluid Catalytic Cracking").

After reaching, upon completion of the cracking reactions, the desired range of molecular weight combined with a corresponding reduction of the boiling point, the reaction effluents are separated from the particles. The latter, deactivated under the influence of the coke which has deposited on their surface, are generally stripped in order to recover the hydrocarbons carried along, then regenerated by combusting the coke, and finally once again put in contact with the charge to be cracked.

The reactors used are most frequently tubular-type vertical reactors in which the charge and the particles move in an essentially rising flow (in which case the reactor is then called a "riser") or in an essentially downward flow (in which case the reactor is then referred to as a "dropper" or "downer").

One major difficulty which such procedures encounter is crack the charge, at the same time, completely and selectively, i.e., to succeed in cracking the entire charge in order to obtain a maximum quantity of valuable hydrocarbons while minimizing the quantity of undesirable byproducts. This object is even more difficult to attain considering that the charges to be cracked have relatively wide boiling point ranges and contain very different components which crack under significantly different conditions to produce a variety of products.

For that reason, the procedures currently in use lead to generally incomplete conversion of the charge. With these procedures, cracking is performed in a single reactor whose operating conditions, chosen depending of the average nature of the hydrocarbons making up the charge, do not make it possible to properly crack the entire range of hydrocarbons present to selectively obtain the desired products. As a result, reaction effluents are obtained which contain very different products, a significant percentage of which are the result of insufficient cracking of the charge and which represent undesired, difficult-to-use products for the refiner.

A first solution consists in recycling all or part of the products obtained as a result of the cracking reaction in order to reprocess them in a second cracking stage. Such a measure, however, is not only very inefficient, but also detrimental, insofar as a result of such recycling, the cracking quality of the fresh charge is frequently notably affected.

A second solution consists in increasing the cracking intensity to more comprehensively crack the charge injected and convert all types of hydrocarbons that are present. Such a measure, however, although making it possible to increase the conversion rate of the charge, in turn promotes overcracking phenomena, which translate to a decrease in conversion selectivity: an increased production of dry gases and coke is observed, to the detriment of the desired intermediate hydrocarbons.

Several solutions have been proposed in prior art to overcome the above-mentioned difficulties.

Since 1947, U.S. Pat. No. 2,488,713 has been proposing a catalytic cracking process using two successive reactors in each of which catalytic particles circulate. In the first reactor, a heavy recycled cut (a residue resulting from the fractionation of the cracking effluents, of the type known by the name "slurry") is cracked in contact with catalytic particles from a regenerator. In the second reactor, a fresh charge as well as an intermediate recycled cut of the distillate type are cracked in contact with particles from the first reactor. At the outlet of either of the two reactors, the hydrocarbonated effluents are stripped of particles, then combined and directed towards a conventional fractionating column.

The first disadvantage of such a procedure is that the fresh charge is treated, in the second reactor, in the presence of particles which have already been largely coked and deactivated in the first reactor, in contact with the heavy recycled charge, which is particularly rich in resistant polyaromatic components. As a result, in the second reactor, these particles perform poorly in terms of catalytic activity, which leads to mediocre cracking of the fresh charge, while producing at the same time a low conversion rate and poor selectivity.

A second disadvantage is due to the fact that the heavy recycled cut is progressively enriched with the most resistant heavy components which, even if they are recycled in the first reactor, do not crack at all or only incompletely, and "go around and around" in the unit. This aggravates the problems described above in terms of premature coking of the particles in the first reactor. Purging in the recycle line does not resolve this problem in a satisfactory manner. As a matter of fact, since the recycled cut consists of the fractionating residue of the combined effluents of the two reactors, purging not only extracts only a part of the most resistant components which are supposed to be removed from the unit, but also additionally extracts a fraction of the components directly coming from the fresh charge which have not been converted while passing into the second reactor, but which could have been cracked in the first reactor in contact with the regenerated particles. The poor selectivity of this purging system therefore causes an additional loss of yield in terms of desired products.

In addition, EP No. 573316 describes a catalytic cracking procedure wherein the reaction occurs in two successive reactors, the first reactor being a downer, and the second a riser. The charge to be cracked is brought into contact with regenerated particles at the inlet of the downer, at the bottom of which the charge/particle mixture is transferred to the riser. The charge then circulates in contact with the participles in the two successive reactors, which makes it possible to increase the overall yield of cracked hydrocarbons. However, this procedures is not fully selective: hydrocarbons already converted in the first reactor are once again cracked in the second reactor, which leads to an overcracking phenomenon, resulting in increased production of dry gases and coke, to the detriment of the desired intermediate cuts.

In the pursuit of its research in the field of fluidized bed cracking, the Applicant has become interested in procedures in which two cracking reactors are used in order to improve the rate and selectivity of the conversion as compared with traditional procedures using only one single reactor. In the process, the Applicant has developed a procedure which makes it possible to overcome the disadvantages of prior art systems.

For that purpose, this present invention concerns a fluidized bed cracking procedure wherein cooling, optionally catalytic, particles circulate in two successive reaction chambers in each of which they are brought into contact with at least one cut of hydrocarbons, and the reaction effluents originating in each of said chambers are directed to one and the same fractionating unit.

This procedure is characterized in that the effluents from each of the reaction chambers are cracked in part separately in one and the same fractionating column, in particular a partitioned fractionating column, and in that at least one cut obtained through separately cracking the effluents from one of the two reaction chambers is entirely or in part reinjected into the other chamber.

For the purposes of this present invention, the term "reaction chamber" refers to any enclosure provided with means for the introduction of cooling particles (whether catalytic or not), means for the injection of one or more cuts of hydrocarbons to be cracked, a cracking reaction area, and means for the separation of the cracking effluents and the particles. This terms includes in particular any type of thermal or catalytic fluidized-bed cracking reactor, regardless of its mode of operation (riser or downer).

In accordance with this present invention, the hydrocarbons are cracked in a first reaction chamber in contact with fully activated particles from the regenerator. At the outlet of such first chamber, the effluents are stripped of the particles, and the latter continue their course into a second reaction chamber in which their residual activity is used to crack an additional quantity of hydrocarbons.

Considering the charge to be cracked, such charge is subjected to a first conventional cracking stage in one of the two reaction chambers. The corresponding effluents are then cracked in the same fractionating column as the effluents originating in the other chamber, although in part separately. Then, after separately cracking the effluents from the first cracking stage, one or several cuts contained the undesired products are recovered. These cuts are then, either entirely or in part, reinjected into the other reaction chamber, where they undergo a second cracking stage independently from the first one, and wherein the operating conditions can be adjusted depending on the nature of these hydrocarbons reinjected and the type of the desired products to be obtained.

Such a step-by-step procedure is possible thanks to the special fractionating column used in this present invention. As a matter of fact, this column is partially partitioned off, which makes it possible to crack the effluents from each of the two reactors in part separately, i.e., without contact between them. Of course, the part of the effluents of the two reactors cracked separately in such a manner corresponds to the part containing cuts that are rich in undesired products, which the refiner wishes to subject to a second cracking stage. The other part of said effluents is combined in the non-partitioned area of the column, where the effluents are cracked together.

Compared with traditional systems using but a single reactor, the procedure in accordance with this present invention permits a conversion of the charge to be cracked which is simultaneously more comprehensive and more selective. As a matter of fact, the refiner can reinject low-value products obtained during the first conventional cracking stage to once again crack products in a second cracking stage. The fact that said products are recycled in a different reactor is advantageous insofar as, on one hand, such second cracking can be performed under suitable conditions and, on the other, adverse impacts on the quality of the first cracking stage of the charge is avoided.

Compared with systems using two reactors proposed in prior art, the procedure in accordance with this present invention makes it possible to subject the hydrocarbons making up the charge to separate cracking cycles which are perfectly adjusted depending on the different nature of such hydrocarbons to obtain a maximum quantity of high-value products. As a matter of fact, the charge to be cracked undergoes a first conversion, upon completion of which the undesired products obtained are cracked separately from the effluents from the other reactor, in a compartment in the partitioned area of the fractionating column. These products are then reinjected into a different reactor in which they undergo a second cracking stage under conditions that are specifically suited for their nature.

The effluents resulting from the second cracking stage are then cracked in the same column as the effluents from the first cracking stage, and the partitioned fractionating system of such column makes it possible to avoid that the residual undesired components which have not been converted after passing through the two reactors (in particular particularly resistant cracking components) are recycled a second time and "go around and around" in the unit. As a matter of fact, such components are recovered in the fractionating column in the partitioned compartment of the effluents from the second cracking stage. These components are therefore recovered separately from the effluents from the first cracking stage and can, for example, be eliminated from the unit. This system makes it possible to inject, in one of the reaction chambers, only hydrocarbons originating exclusively in the other chamber. As a result, a phenomenon of enrichment of the recycled cuts with resistant components, which would progressively adversely impact the cracking quality of such cuts, which would result in excessive coking of the particles circulating in the unit, is avoided.

The procedure in accordance with this present invention therefore makes it possible to take better advantage of the undesired products resulting from the first conventional cracking stage to produce an additional quantity of products with a higher added value. While using the same base charge, it offers the refiner the option to perform more comprehensive and selective cracking in terms of the type of desired products. The profitability of the unit is notably improved.

In addition, the Applicant has developed a device which permits the efficient implementation of the procedure in accordance with this present invention.

This present invention therefore also concerns a fluidized bed device for cracking a hydrocarbon charge which uses two reaction chambers connected with each other via a means for the transfer of cooling particles, a fractionating column, and conduits for the supply of hydrocarbonated effluents from either of the two chambers to said fractionating column.

This device is characterized in that:

said fractionating column comprises, in its internal part, at least two different areas: a first partitioned fractionating area with two compartments, each of which communicates with a second common fractionating area;

the conduits for the supply of effluents from the first and the second reaction chamber terminate, respectively, in the first and second compartment of said partitioned fractionating area;

means are provided for recycling and injecting, in one of the reaction chambers, at least one cut drawn off from the partitioned fractionating compartment of the effluents of the other fractionating chamber.

A first advantage of the device in accordance with this present invention is related with the fact that the hydrocarbonated effluents from the two reaction chambers are treated in part separately, although in one and the same fractionating column. This system makes it possible to avoid the use of two distinct columns and therefore permits the use of a compact unit, as a result of which [additional] investments are avoided.

A second advantage of this device is related with the fact that it permits the optimal implementation of the procedure in accordance with this present invention. As a matter of fact, said partitioned fractionating area is advantageously sized depending on the boiling points of the undesired products which the refiner wishes to recrack in a second cracking stage. The common fractionating area, in turn, is used to crack products for which the refiner does not wish to distinguish whether they originating in either of the reaction chambers, for example because they are products that can be used directly, which are not supposed to be recracked.

The two reaction chambers used in this present invention are referred to herein as the "first" and "second" reaction chamber, it being understood that this order is adopted on the basis of the direction of circulation of the cooling particles from the regenerator. In either of the two chambers, hydrocarbons can be injected into or against, respectively, the direction of flow of the cooling particles.

These two reaction chambers can, in particular, be provided in the form of any type of reactors with downward (downer) or upward (riser) flow. Although the two chambers can be perfectly identical, the procedure in accordance with this present invention is even more advantageous in case said chambers are different. This makes it possible, in particular, to establish different operating conditions in these two chambers which are adjusted depending on the type of hydrocarbons injected into each of them.

In particular, a preferred embodiment of the procedure in accordance with this present invention, the hydrocarbons injected into the first reaction chamber reside therein for a shorter period of time than the hydrocarbons injected into the second reaction chamber. As a matter of fact, cracking in the first reaction chamber occurs in the presence of particles arriving directly from the regenerator and therefore at a particularly high temperature and with maximum activity. As a matter of fact, it has been found to be preferable to avoid prolonged contact between these particles and the hydrocarbons in order to, on one hand, avoid overcracking and, on the other, limit the quantity of coke deposited on the particles, which, as a result thereof, preserve part of their heat and their activity for cracking the hydrocarbons injected into the second reaction chamber.

In the second reaction chamber, in turn, cracking occurs under "softer" conditions, considering that the particles have in part cooled down, i.e., they have been deactivated, while passing through the first reaction chamber. For that reason, it has been found to be advantageous to prolong the contact between the particles and the hydrocarbons in order to permit sufficiently comprehensive cracking of the same.

Advantageously, the time the hydrocarbons injected into the first reaction chamber reside in the same ranges from 0.05 to 5 seconds, preferably between 0.1 and 1 second. Insofar as the time the hydrocarbons injected into the second reaction chamber reside in the same is concerned, the range is advantageously between 0.1 to 10 seconds, preferably between 0.4 and 5 seconds.

In a preferred embodiment hereof, the charge and the catalyst essentially flow downward in the first reaction chamber. Said reaction chamber can therefore be provided in the form of a notably vertical reactor with downward flow of the type known by the name of "downer," as described e.g. in the International Patent Application WO 98/12279. As a matter of fact, such type of reactor permits a particularly brief contact between the hydrocarbons and the fluidized bed of particles.

In another preferred embodiment hereof, the charge and the catalyst essentially flow upward in the second reaction chamber. Said reaction chamber can therefore be provided in the form of a notably vertical reactor with upward flow of the type known by the name of "riser." As a matter of fact, such type of reactor permits longer contact between the hydrocarbons and the fluidized bed of particles.

This present invention presents numerous implementations, among which the refiner will know how to chose the most suitable implementation for the type of products he wishes to obtain, considering the type of charges to be cracked that are available.

In a first particularly advantageous embodiment hereof, the heavy part of the effluents from the two reactors are cracked in a partitioned section. As a result, the heaviest effluents from either of the two reaction chambers are cracked separately while the lighter effluents are combined.

This configuration makes it possible to subject the products from the first stage of cracking of the charge to a second cracking stage. In an advantageous manner, said cut resulting from separately cracking the effluents of one of the reaction chambers and which is, as a whole or in part, reinjected into the other chamber comprises slurry and/or a heavy distillate of the type HCO.

In the field of petroleum refining, the term "HCO" (based on the English "heavy cycle oil") usually refers to a heavy cut whose boiling point can range from an initial point generally between 320° C. and 400° C. to a final point generally between 450° C. and 480° C. HCO is a product of little value, rich in sulfur and aromatic compounds, which is generally used to dilute heavy fuels.

Insofar as the product commonly referred to as "slurry" is concerned, slurry consists of the fractionating residue of the cracking effluents. Slurry is a very heavy, highly viscous product whose initial cut point in general ranges from 450 to 480° C. Such residue is even more difficult to convert into a product of value since it is particular rich in polyaromatic components and contains a significant share of fine [matter], i.e., dust resulting from the erosion of the cooling particles circulating in the unit.

It is therefore particularly useful to subject the heavy products of the type HCO and slurry to a second cracking stage, even more since such measure makes it possible to product more valuable intermediate products, such as diesel oils, gasolines, GPL.

In addition, for these types of embodiments where heavy type cuts are recycled, it has been found to be preferable to inject such cuts in the second reaction chamber. As a result, the risks of premature coking of the cooling particles in the first reaction chamber is avoided. There, in an advantageous manner, all or part of the fresh charge can be injected into the first reaction chamber. As a result, in a particular advantageous configuration, at least one cut resulting from separately cracking the heaviest effluents of the first reaction chamber is, as a whole or in part, reinjected into the second reaction chamber.

A second particularly advantageous embodiment hereof consists in partitioning off the cracking of the light part of the effluents from the two reactors. As a result, the lightest effluents from each of the two reaction chambers are cracked separately whereas the heaviest effluents are combined.

This configuration makes it possible to subject the light products from a first stage of cracking of the charge to a second cracking stage. In an advantageous manner, said cut resulting from separately cracking the effluents of one of the reaction chambers and which is, as a whole or in part, reinjected into the other chamber comprises gasoline. Usually, the term "gasoline" refers to cuts whose boiling point can range from an initial point generally higher than or equal to 20° C. to a final point generally between 140° C. and 220° C. It can be particularly advantageous for the refiner to subject these types of products to a second cracking stage insofar as this increases the production of light olefins such as, for example, propenes and butanes, which represent very desirable products, in particular for application in the field of petrochemistry.

For these embodiments wherein light cuts are recycled, it can be preferable to inject these recycled cuts in the first reaction chamber. As a matter of fact, insofar cracking of gasolines into light olefins, which requires particularly high temperatures, is concerned, it has been found to be more efficient to perform such conversion in the presence of particles arriving directly from the regenerator. The fresh charge can then be injected, as a whole or in part, into the second reaction chamber. In this manner, in a particularly advantageous configuration, at least one cut resulting from separately cracking the lightest effluents of the second reaction chamber is, as a whole or in part, reinjected into the first reaction chamber.

In accordance with this present invention, at least one cut resulting from separately cracking the lightest effluents of one of the reaction chambers is, as a whole or in part, reinjected into the other reaction chamber. The proportions that are reinjected depend in particular on the nature (more or less dense, more or less difficult to crack, [etc.]) of the cuts in questions. These proportions must also take into account the operating conditions prevailing in the reactor in which such cuts are reinjected, in order to ensure complete vaporization and cracking of the recycled hydrocarbons. For each cut recycled in such a manner, the proportion reinjected is advantageously between 10 and 100% of the flow of such cut. More preferably, such proportion is between 50% and 100%.

In addition, each of the cuts reinjected can prior to such reinjection be combined with other cuts of hydrocarbons.

For example, in the case of separately cracking heavy effluents with reinjection of a viscous slurry-type cut, it can be particularly advantageous to dilute, by using a lighter cut, the reinjected fraction of such slurry in order to facilitate reinjection. The diluting agent may e.g. comprise the fresh charge, in particular conventional charges of the type diesel oils or distillates. The diluting agent can in addition comprise, for example, light cycle oils (LCOs) or heavy cycle oils (HCOs).

Finally, either of the cuts that is reinjected can, prior to such reinjection, be subjected to one or several intermediate treatments. Advantageously, such intermediate treatment includes a hydrotreatment, such as e.g. hydrogenation, hydroaromatization, hydrosulfuration, [or] hydrodeazotation. Such treatments are usually carried out in the presence of catalysts known to those in the art and which usually comprise, deposited on a resistant mineral oxide support, one or several metals of the Group VIII of the Periodic Table of Elements, possibly associated with other metals such as those of Group VI of the Periodic Table of Elements.

In the second reaction chamber, the hydrocarbons are cracked in the presence of cooling particles originating in the first chamber, where they have been partially coked, i.e., deactivated, in contact with the charge injected into this first chamber. In a particularly advantageous variation of this present invention, upstream from such second reaction chamber, an auxiliary quantity of particles from the regenerator is introduced. This variation is found to be particularly beneficial in case the heat supplied by the particles from said first chamber is insufficient to vaporize the hydrocarbons injected into the second reaction chamber. The auxiliary quantity of particles regenerated therefore makes it possible to supply an additional quantity of heat and to control the temperature prevailing in said second chamber. In addition, in case said particles are catalytic particles, this system is additionally advantageous insofar as, in the second chamber, an auxiliary quantity is introduced in fully active catalytic sites to optimize the cracking reactions of the hydrocarbons injected into such second chamber.

Preferably, the auxiliary quantity of particles is introduced between the area where the particles and the effluents of the first reaction chamber are separated and the area where hydrocarbon cuts are injected into the second reaction chamber. Said auxiliary quantity is advantageously introduced in such a manner as to ensure a homogenous mixture with the particles from the first reactor. For that purpose, a particle fluid bed homogenization system as described in patent application EP No. 99.401112 in the name of the Applicant can be particularly useful.

This present invention describes a special fractionating column. As a matter of fact, such fractionating column must permit the simultaneous distillation of the effluents from the two reactors and must be controlled in such a manner that these two types of effluents are fractionated in part separately and in part together.

For that purpose, the inside of said column has two areas:

a partitioned fractionating area in which the effluents from the two reactors are cracked separately, each in a [separate] compartment, to prevent any contact between them, and a common fractionating area, wherein the effluents from the two reactors are mixed.

This partial segregation of the effluents from the two reactors is performed by using a partition disposed inside of the column, wherein such partition divides a part of said column into two compartments which represent such a partitioned fractionating area.

This partially partitioned fractionating column can be controlled in a number of different ways depending on the part of effluents which are desired to be cracked separately.

For example, in case it is desired to separately crack the heavy parts of the effluents from each of the two reactors, the partitioned fractionating area corresponds to the lower part of the fractionating column. In this case, different partitions can be envisioned for the device in accordance with this present invention.

In a first embodiment hereof, the partitioned fractionating area is separated into two compartments by using a notably vertical separation means extending from the back of the fractionating column over part of the height of the same. For example, such separation means may be a plane vertical wall, or also a cylinder-shaped vertical wall whose axis of revolution runs parallel to the longitudinal axis of the fractionating column.

In a second embodiment hereof, the partitioned fractionating area is divided into two compartments thanks to a notably horizontal separation means, e.g. in the form of a plate extending over a horizontal section of the column and provided with one or several chimneys permitting the passage towards the top, towards the common fractionating area, of the light effluents from the compartment below such plate.

In a substantially similar manner, in case it is desired to separately crack the light part of the effluents from each of the two reactors, the partitioned fractionating area corresponds to the upper part of the fractionating column. Again, different partitions can be installed.

In a first embodiment hereof, the partitioned fractionating area is separated into two compartments by using a notably vertical separation means extending from the top of the fractionating column over part of the height of the same, such as, for example, a plane vertical wall or a cylinder-shaped vertical wall whose axis of revolution runs parallel to the longitudinal axis of the fractionating column.

In a second embodiment hereof, the partitioned fractionating area is divided into two compartments thanks to a notably horizontal separation means, e.g. represented by a plate extending over a horizontal section of the column and provided with one or several chimneys permitting the passage towards the bottom, towards the common fractionating area, of the heavy effluents from the compartment above such plate.

The operating conditions under which either of the two reaction chambers functions may vary. They are preferably different in each of the two chambers, considering the different natures of the hydrocarbons that are injected. Generally speaking, these operating conditions include a reaction temperature ranging between 450° C. and 900° C. and a pressure in the vicinity of the atmospheric pressure. Those in the art are perfectly aware of how to optimize these conditions depending on the type of petroleum cuts to be cracked.

The charges of hydrocarbons which can be cracked within the scope of this present invention can be extremely diverse. They include in particular, but are not limited to the usual charges used in cracking procedures such as, for example, distillates and/or diesel oils resulting from atmospheric or vacuum distillation, distillates and/or diesel oils resulting from visbreaking, deasphalted residues, etc.

The procedure in accordance with this present invention is, additionally, perfectly suitable for the conversion of heavier charges containing fractions with a usual boiling point of 700° C. and beyond and which can contain high quantities of asphaltenes and with a Conradson carbon content of 4% and more. The charge can therefore include heavy distillates, atmospheric distillation residues, even vacuum distillation residues.

If necessary, the charges injected can have been subjected to prior treatment such as, for example, hydrotreatment in the presence of a suitable catalyst, e.g. a cobalt-based or molybdenum-based catalyst deposited on a porous resistant oxide.

In order to facilitate the injection of the charge to be cracked, especially in the case of a viscous charge, it can additionally be diluted by using or more lighter cuts, which can include intermediate cuts from the fractionating area of the cracking effluents. For that purpose, the LCOs and HCOs mentioned above may represent excellent diluting agents.

Within the scope of this present invention, it does not appear to be necessary to mentioned the type of cooling particles, whether catalytic particles or not, that arc used, nor the means that are used to circulate such particles in the form of fluidized beds more or less diluted by gaseous diluting fluids, considering that they are well known to those in the art.

The different forms of implementation of the invention mentioned above shall be described below with reference to the drawings attached hereto. These drawings are only intended to illustrate the invention and do not limit the same in any fashion whatsoever, and procedure being the subject-matter of this present invention can be implemented in a very large number of different ways.

In these drawings:

FIG. 1 shows a catalytic cracking unit comprising two successive reaction chambers, wherein the first reaction chamber is a downer, and the second reaction chamber is a riser.

Figure 1:
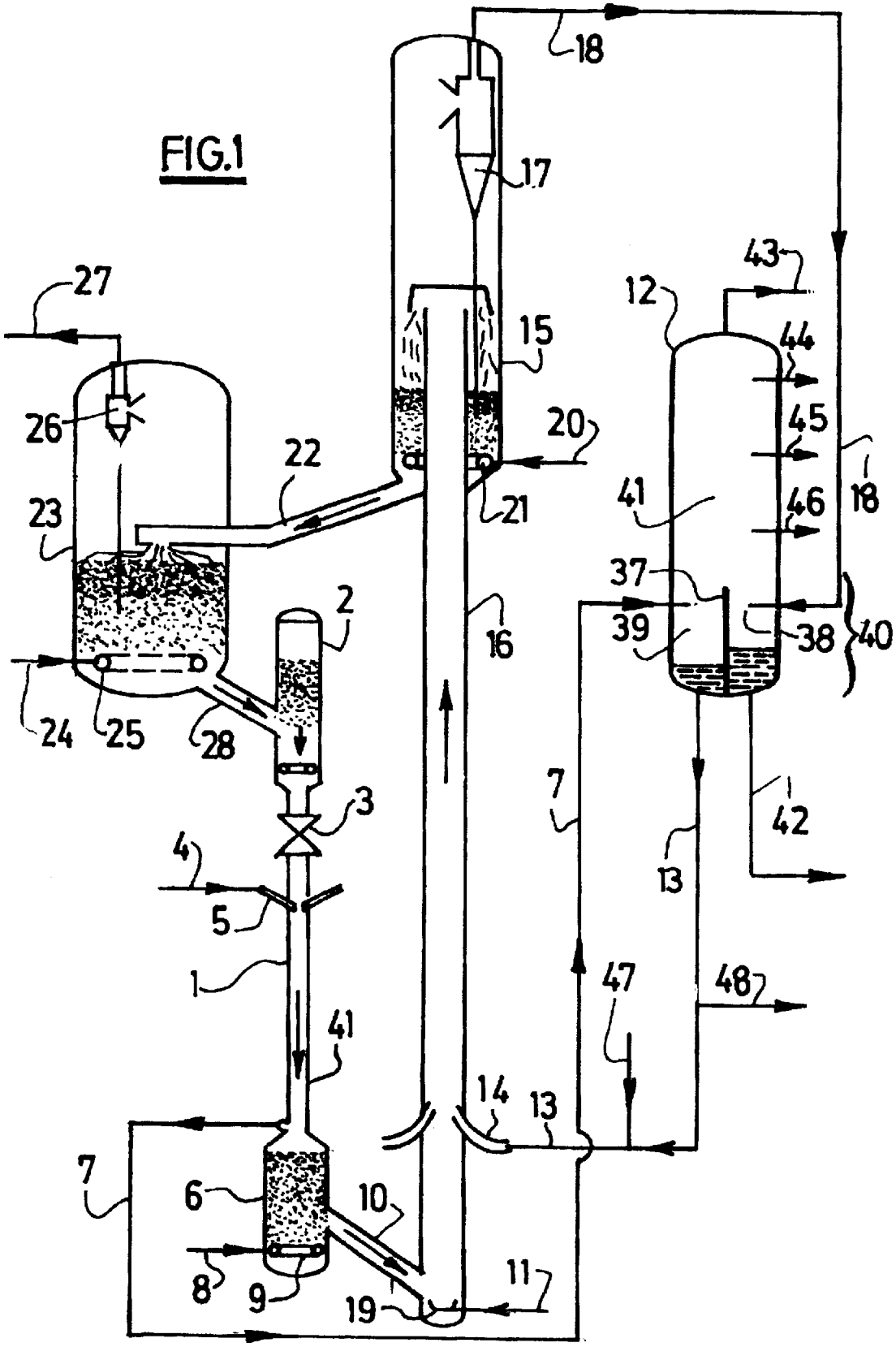
FIG. 1 is a schematic view of a first embodiment of the cracking procedure in accordance with this present invention wherein the heavy part of the effluents from the two reactors is cracked in a partitioned section.

This unit comprises a first reaction chamber represented by a tubular reactor 1 with downward flow, known by the name "downer." This reactor is connected, in its upper part, with an enceinte 2 from where it is supplied with a flow of regenerated catalytic particles at a flow rate regulated by means of a valve 3.

The charge to be cracked is supplied via the line 4 and injected into the reactor 1 by means of injectors 5. The catalytic particles and the hydrocarbons therefore flow from the top to the bottom of the reactor 1.

At the base of the reactor 1, the mixture flows into the enceinte 6, in the upper part of which a separator (not shown herein) strips the catalytic particles from the reaction effluents, which are directed towards the fractionating area via the line 7. In the lower part of the enceinte 6, the particles are stripped by means of water steam supplied via the line 8 to the diffuser 9.

The particles are then removed via the conduit 10 outside of the enceinte 6 and transferred to the base of the second reaction chamber. Such second reaction chamber is constituted by a reactor 16 in the form of a column, of the type known from prior art as a "charge elevator" or riser. The reactor 16 is supplied at its base via the conduit 10 with catalytic particles.

Optionally, a conduit (not shown) can be provided to supply an auxiliary quantity of regenerated particles arriving directly from the regenerator 23, to be described in more detail further on, whose flow rate is regulated in such a manner as to optimize the cracking conditions in the second reactor.

A riser gas, for example water steam, is introduced into the column 16 via the line 11 by means of a diffuser 19, whereas a charge containing a substantial proportion of a cut obtained through separately cracking of the heaviest effluents of the first reactor 1 is conducted via the line 13 and injected into the reactor 16 by means of injectors-atomizers 14. The catalytic particles and the hydrocarbons then flow from the top to the bottom of the reactor 16.

The column 16 terminates at its peak in an enceinte 15 which is provided e.g. concentrically around it and in which the cracked charge is separated and the deactivated catalytic particles are stripped. The particles are separated from the treated charged by means of a cyclone 17 which is accommodated in the enceinte 15, at the peak of which an evacuation line 18 is provided for the effluents of the second reactor 16, which are conducted towards the fractionating area. The deactivated particles are displaced by gravity towards the base of the enceinte 15. A line 20 supplies a stripping fluid, generally water steam, from the fluidization gas injectors or diffusers 21 disposed regularly at the base of the enceinte 15.

The particles are then evacuated at the base of the enceinte 15 towards a regenerator 23 via the conduit 22. In the regenerator 23, the coke deposited on the particles is burned by using air or another oxygen-rich gas injected at the base of the regenerator 23 via a line 24 which supplies the regularly spaced injectors or diffusers 25. The particles carried along by the combustion gas are separated by the cyclones 26, and the combustion gas is removed via a line 27, whereas the particles flow towards the base of the enceinte 23, from where they are recycled via the conduit 28 towards the supply enceinte 2 of the first reactor 1.

The reaction effluents from each of the reactors 1 and 16 are conducted, respectively, via the lines 7 and 18 towards the fractionating column 12. The latter is constituted by two areas: a partitioned lower fractionating area 40, and a common upper fractionating area 41. The partitioned lower fractionating area 40 is divided into two compartments 38 and 39 by a separation means 37 in the form of a plane vertical wall which extends from the back of the column 12 over a part of the height of the same.

In accordance with this present invention, the lines 7 and 18 for the supply of the effluents of the two reactors terminate, on one side and the other of the separation means 37, in the respective compartments 39 and 38, where the corresponding heavy products are cracked separately. These products correspond to distillation residues or "slurry" whose initial cut point is preferably chosen at a value between 450 and 480° C.

The two compartments 38 and 39 communicate with the common fractionating area 41, which is situated in the upper part of the column 12 and where the lighter products contained in the combined effluents of the two reactors 1 and 16 are cracked.

Fractioning through distillation of these lighter fractions is performed in the classical manner to obtain the desired products. In particular, those in the art are perfectly aware of how to chose the points cut depending on which products they wish to obtained. Traditionally, such distillation is carried out in order to isolate:

- gaseous products at normal temperature and pressure conditions (hydrocarbons in C1 to C4), drawn off via the line 43;
- a cut of gasolines whose boiling point range can be between 20° C. to approx. 140–220° C., drawn off via the line 44;
- a cut of a type of diesel oil or LCO whose boiling point range generally extends from 140–220° C. to approx. 320–400° C., drawn off via the line 45;
- a cut of the type distillate or HCO whose boiling point range generally extends from 320–400° C. to approx. 450–480° C., drawn off via the line 46.

Of course, the fractionating area can certainly include additional classical columns (not shown herein) that are coupled to the column 12 wherein a part of the common effluents can be cracked or subsequently cracked as described above.

In the procedure proposed herein, only the residues of the effluents of the two reactors are cracked separately. It is of course absolutely possible to separately crack other heavy products such as, in particular, HCO, even LCO, in order to recycle all or part of the same towards the second reactor 16, whether along or in a mixture with slurry. For that purpose, it is sufficient to use a separation means 37 extending over a significant >height of the column 12 in such a manner that the partitioned fractionating area 40 also covers the distillation and removal area of HCO (even LCO).

The residues which have condensed in the compartments 38 and 39 are drawn off, respectively, via the lines 42 and 43. The cut drawn off via the line 13, which corresponds to the slurry obtained through separately cracking the effluents of the first reaction chamber 1, is, in accordance with this present invention, recycled towards the second reaction chamber 16. Optionally, the line 47 makes it possible to dilute this base fraction with a less viscous cut, for example by all or part of the HCO cut drawn off via the line 46. Also optionally, the line 48 makes it possible to draw off part of said base fraction so as to ensure that only a given proportion is injected into to the reactor 16.

Insofar as the cut drawn off via the line 42 is concerned, it corresponds to the slurry obtained through separately cracking the effluents of the second reaction chamber 16. This cut, which contains particularly resistant components that have not been converted after successive cracking in each of the two reactors, can e.g. be removed from the unit.

Figure 2:
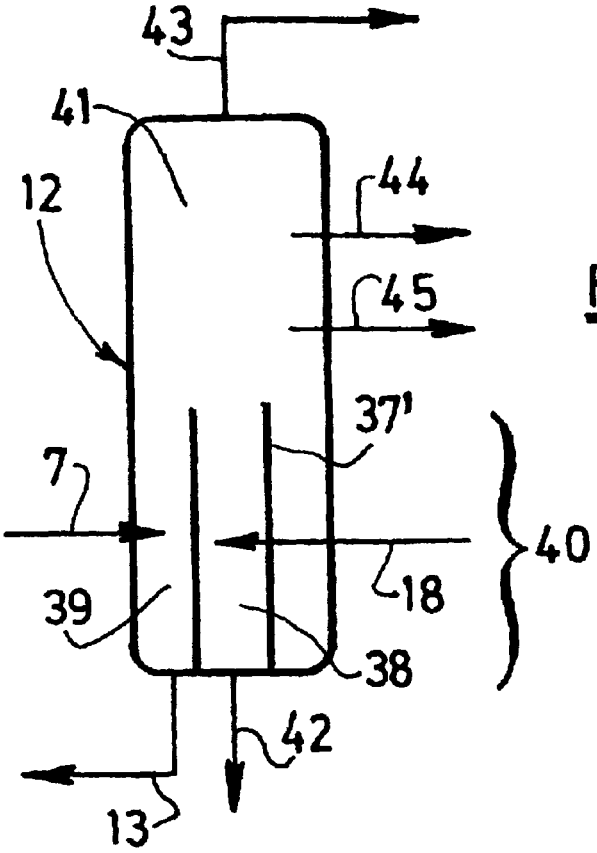
FIGS. 2 and 3 represent two possible variations for the partially partitioned fractionating column used in the procedure illustrated in FIG. 1.

FIG. 2, in which the elements already described in FIG. 1 are designated by the same reference numbers, represents a first embodiment of the fractionating column 12, where a different means is used to partition off the lower part 40 of said column.

In FIG. 2, the column 12 has a separation means which, like in FIG. 1, is represented by a notably vertical partition which extends from the back of the column 12. In this case, however, this partition element is a cylinder-shaped vertical wall 37' whose axis of revolution runs parallel to the longitudinal axis of the column 12. This cylinder-shaped element is disposed in the interior and concentrically with respect to the wall of the column 12 and extends from the back of the same at a sufficient height, thereby dividing the partitioned fractionating area 40 into two compartments 39 and 38, in which, respectively, the supply line 7 of the effluents of the first reaction chamber 1 and the supply line 18 of the effluents of the second reaction chamber 16 terminate. In this configuration, the two compartments 38 and 39 are therefore concentrical.

Each compartment 38 and 39 communicates directly with the common fractionating area 41 situated above where, in a classical manner, the lighter productions contained in the combined effluents of the two reactors are cracked.

In the variation shown in FIG. 2, the partition element 37' extends over a more significant height of the column 12 to also cover the area of distillation of type HCO distillates. In addition, the HCO is not separated from the slurry, although the residues, drawn off via the lines 42 and 13 in the back of each of the two compartments 38 and 39, respectively, represent a mixture of these two types of products.

The residue drawn off via the line 13, representing a mixture of HCO and slurry obtained through separately cracking heavy effluents of the first reaction chamber 1 is, in accordance with this present invention, recycled as whole or in part towards the second reaction chamber 16.

Of course, the supply lines 7 and 18 can definitely inverted so as to also invert the two removal lines 13 and 42 of the corresponding products.

Figure 3:
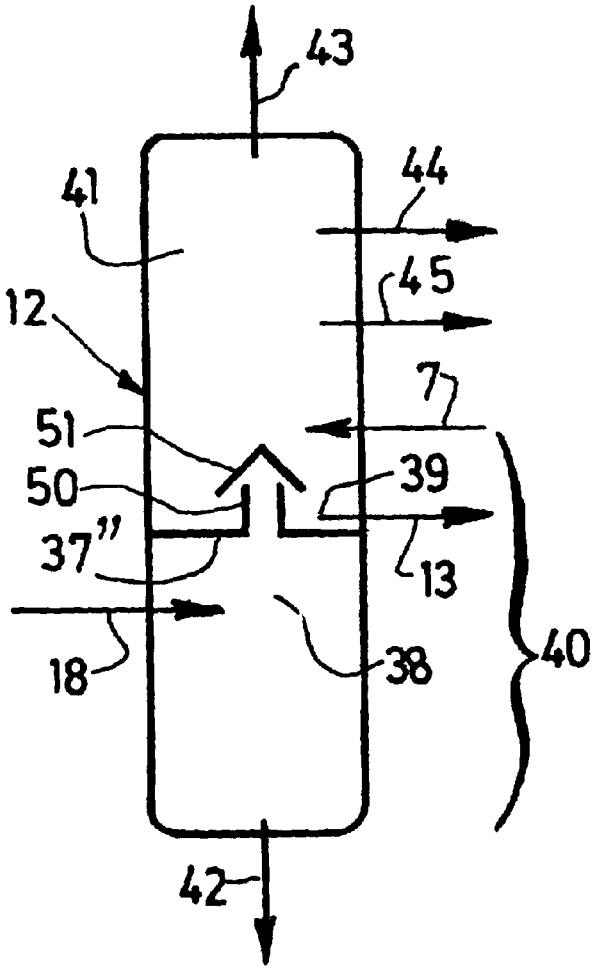

FIG. 3, in which the elements already described in FIG. 1 are once again designated by the same reference numbers, represents a second embodiment of the fractionating column 12 shown in FIG. 1, wherein the means 37" for the separation of the lower partitioned fractionating area 40 is a horizontal means.

In FIG. 3, the area 40 is provided with an internal partition element in the form of a horizontal plate 37" which is sized in such a manner as to cover the entire transversal section of the column 12 and to be in close contact with the internal vertical wall of the same.

The partition element delimits a first upper compartment 39 in which the line 7 supplying the effluents from the first reaction chamber 1 terminates as well as second lower compartment 38 in which the line 18 supplying the effluents from the second reaction chamber 16 terminates. In this configuration, the two compartments 38 and 39 are therefore disposed one on top of the other.

Each compartment 38 and 39 communicates directly with the common fractionating area 41 situated above. As a matter of fact, the plate 37" is provided with at least one chimney 50 which permits passage towards the top, towards said common fractionating area 41, of the vaporized products from the compartment 38 below the plate 37." The lighter effluents from the second reaction chamber 16 therefore rise via this chimney towards the common area 41, where they are cracked and drawn off via the lines 43, 44, and 45, in a mixture with the light effluents from the first reaction chamber 1.

Over the chimney 50, a hood 51, for example a conical hood, is provided which makes it possible to prevent the hydrocarbons from passing from the upper compartment 39 into the lower compartment 38. This system therefore makes it possible to perfectly segregate the heavy effluents from the two reactors 1 and 16.

The cut drawn off via the line 13 of the partitioned fractionating compartment 39 of the heavy effluents from the first reaction chamber is, in accordance with this present invention, recycled as a whole or in part towards the second reaction chamber 16.

In this variation, like in the variation presented in FIG. 2, the supply lines 7 and 18 can definitely inverted (in which case the heavy effluents of the first reactor 1 are then separately cracked in the lower compartment 38, whereas the heavy effluents of the second reactor 16 are separately cracked in the upper compartment 39) so as to also invert the two removal lines 13 and 42 of the corresponding products.

Figure 4:
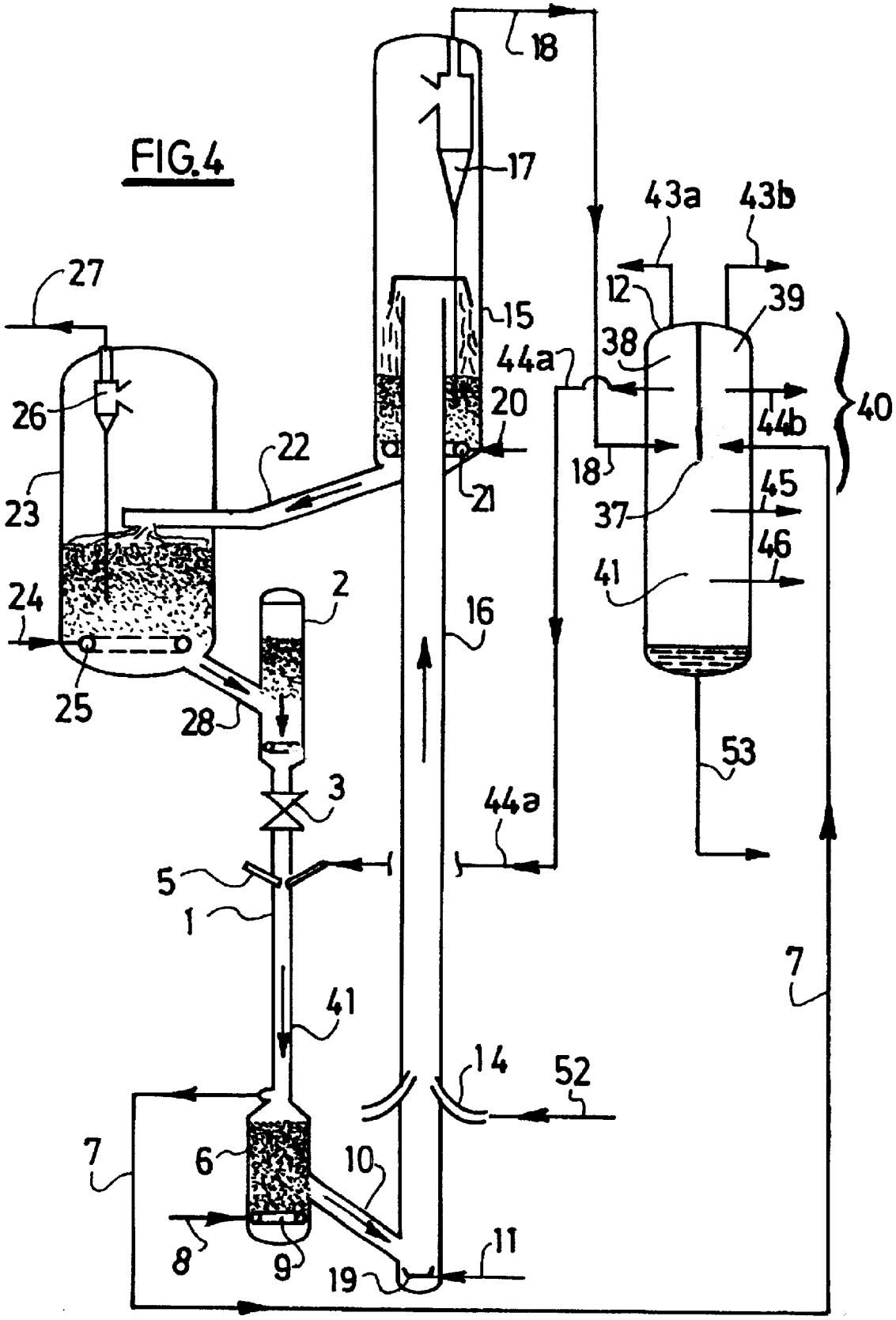
FIG. 4 is a schematic view of a second embodiment of the cracking procedure in accordance with this present invention wherein the light part of the effluents from the two reactors is cracked in a partitioned section.

FIG. 4 also shows a catalytic cracking unit comprising, like the one shown in FIG. 1, a first reaction chamber with downward flow and a second reaction chamber 16 with upward flow. This unit comprises a number of common elements with the one shown in FIG. 1 designated by the same reference numbers, as a result of which only the different elements are described below.

The procedure illustrated in this FIG. 4 corresponds to an embodiment of this present invention where the lightest fluids from each of the two reactors 1 and 16 are separately cracked for the purpose of reinjection into one of them of the light products originating in the other.

For that purpose, the fractionating column 12 has an upper partitioned fractionating area 40 for light effluents and a lower common fractionating area 41 for heavy effluents. The partitioned fractionating area 40 is divided into two compartments 38 and 39 by a separation means 37 in the form of a plane vertical wall extending from the top of the column 12 over a part of the height of the same.

In accordance with this present invention, the lines 7 and 18 for the supply of the effluents of the reactors 1 and 16, respectively, terminate, on one side and the other of the separation means 37, in the respective compartments 39 and 38, where the corresponding light products are cracked separately in order to isolate the following:

- gaseous products at normal temperature and pressure conditions (hydrocarbons in C1 to C4), drawn off, respectively, from the compartments 38 and 39 via the lines 43*a* and 43*b*;
- two cuts of gasolines whose boiling point range can be between 20° C. to approx. 140–220° C., drawn off, respectively, from the compartments 38 and 38 via the lines 44*a* and 44*b*.

The cut of gasoline drawn off via the line 44*a* resulting from separately cracking the lightest effluents of the second reaction chamber is conducted to the injectors 5, from where it is reinjected into the first reaction chamber 1. As a matter of fact, although within the scope of this present invention, it is absolutely possible to recycle this cut to the second reaction chamber 16, it has been found to be more efficient to crack such a cut in the first chamber 1, in contact with particles at maximum temperature arriving directly from the regenerator 23. From there, the fresh charge can be wholly or partially be injected into the second reactor 16. For that purpose, it is conducted to the injectors 14 via the line 52.

In the common fractionating area 41 of the column 12, in a classical manner, the heaviest products contained in the combined effluents of the two reactors 1 and 16 are cracked in order to isolate:

- a cut of a type of diesel oil or LCO whose boiling points range generally extends from 140–220° C. to approx. 320–400° C., drawn off via the line 45;
- a cut of the type distillate or HCO whose boiling points range generally extends from 320–400° C. to approx. 450–480° C., drawn off via the line 46;
- a distillation residue or "slurry" whose initial cut point is generally chosen at a value between 450 and 480° C., drawn off via line 53.

Figure 5:
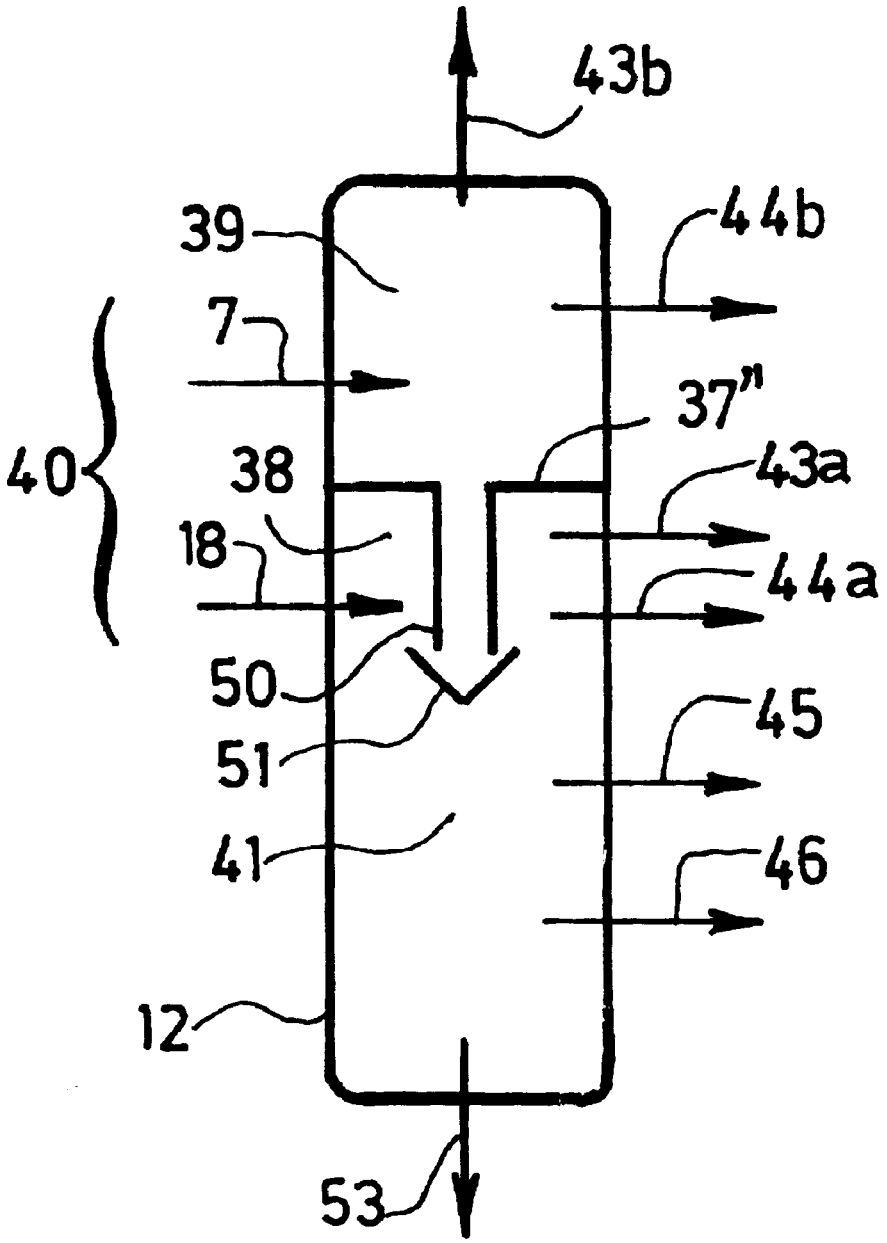
FIG. 5 represents one possible variation for the partially partitioned fractionating column used in the procedure illustrated in FIG. 4.

FIG. 5, in which the elements already described in conjunction with FIG. 4 are designated by the same reference numbers, represents a variation of any embodiment of the fractionating column 12 of this FIG. 4, wherein a separation means 37" of the upper partitioned fractionating area is a horizontal separation means.

In such FIG. 5, the area 40 covers an internal partition element in the form of a horizontal plate 37" which is sized in such a manner as to cover the entire transversal section of the column 12 and to be in close contact with the internal vertical wall of the same.

The partition element delimits a first upper compartment 39 in which the line 7 supplying the effluents from the first reaction chamber 1 terminates as well as second lower compartment 38 in which the line 18 supplying the effluents from the second reaction chamber 16 terminates.

Each compartment 38 and 39 communicates directly with the common fractionating area 41 situated below. As a matter of fact, the plate 37" is provided with at least one chimney 50 which permits the downward passage, towards said common fractionating area 41, of the heavy products from the compartment 39 above the plate 37." The heaviest effluents from the first reaction chamber 1 therefore drop via this chimney towards the common area 41, where they arc cracked and drawn off via the lines 45, 46, and 53, in a mixture with the heavy effluents from the second reaction chamber 16.

The chimney 50 is provided with a baffle 51, for example a conical baffle, which makes it possible to prevent the hydrocarbons from passing from the lower compartment 38 into the upper compartment 39. This system therefore makes it possible to perfectly segregate the heavy effluents from the two reactors 1 and 16.

The cut of gasolines drawn off via the line 44*a* of the partitioned fractionating compartment 38 of the light effluents from the second reaction chamber 16 is, in accordance with this present invention, recycled as a whole or in part towards the first reaction chamber 1.

The examples below are only intended to illustrate the implementation of this present invention as well as the advantages of the same and do not limit the scope hereof in any fashion whatsoever.

EXAMPLES

Example 1

Two catalytic cracking tests were performed by using a heavy petroleum charge consisting of a mixture of 50% by weight of an atmospheric residue and 50% by weight of a vacuum distillate, both obtained by distilling a Kirkuk type crude oil.

The first test was carried out in an experimental catalytic cracking unit like the one shown in FIG. 1, which comprises two successive reaction chambers (1; 16), the first one (1) being a downer, and the second one (16) a riser. The catalyst used is a conventional commercially available zeolite catalyst. In accordance with this present invention, the effluents from either of these two reaction chambers are directed to one and the same fractionating column (12), which is partitioned in its lower part (40) by a plane vertical wall (37). The fresh charge is injected into the first reaction chamber (1) whereas in the second reaction chamber (16), a cut obtained through separately cracking the effluents of the first chamber (1) is injected.

In addition, a comparable test (Test No. 2) was conducted under the same conditions, wherein the partially partitioned fractionating column (12) was replaced by a conventional column in which the effluents of both chambers (1; 16) are combined and cracked in a traditional manner. The fresh charge is injected into the first reaction chamber (1) whereas in the second reaction chamber (16), a cut obtained through the combined cracking of effluents of the two chambers is injected.

In both tests, the cut recycled in the second reaction chamber (16) corresponds to a heavy distillate or HCO with a boiling point range generally between 380 and 480° C. In the test in accordance with this present invention, all HCO obtained through partitioned cracking of the effluents of the first reaction chamber (1) is injected into the second reaction chamber (16). In the comparative Test No. 2, the recycle rate (ratio between the quantity of HCO recycled in the second reaction chamber compared with the total quantity of HCO produced in the unit) is 0.8.

The operating conditions were the same for both tests, to wit:

Temperature at the outlet of the first reaction chamber (1): 540° C.

Temperature at the outlet of the second reaction chamber (1): 515° C.

C/O ratio in the first reaction chamber (1) (mass ratio between the quantity of the catalyst C and the quantity of O of the charge injected into this chamber): 6

C/O ratio in the second reaction chamber (16): 8

Regenerator temperature (23): 690° C.

The table below summarizes the results obtained in terms of conversion rate of the HCO cut recycled in the second reaction chamber (i.e., quantity of HCO converted/quantity of HCO recycled) and yield of conversion products (i.e., weight of the product obtained/weight of HCO converted).

| Yields | Test 1 | Test 2 (Comparative Test) |
|---|---|---|
| Conversion Rate (% by weight) | 34.6 | 24.5 |
| Yield of Dry Gases (% by weight) | 2.2 | 1.5 |
| Yield of GPL (% by weight) | 5.8 | 4.3 |
| Yield of Gasoline (% by weight) | 13.1 | 10.1 |
| Yield of LCO (% by weight) | 20.0 | 20.8 |
| Yield of Slurry (% by weight) | 45.4 | 54.7 |
| Yield of Coke (% by weight) | 13.5 | 8.6 |

In the table above, the products obtained are defined as follows:

Dry gases: light hydrocarbons with 1 or 2 C atoms and hydrogen sulfide ($H_2S$);

GPL: light hydrocarbons with 3 or 4 C atoms;

Gasoline: cut of hydrocarbons whose boiling point is between 20° C. and 220° C.;

LCO: cut of hydrocarbons whose boiling point is between 220° C. and 380° C.;

Slurry: distillation residue containing significant quantities of catalyst dust and whose boiling point is above 480° C.

The above results show that it is much more advantageous to recycle, to the second reactor, the HCO obtained through partitioned cracking of the effluents from the first reactor (Test No. 1) than to recycle the HCO obtained through cracking the combined effluents of the two reactors (Test No. 2).

As a matter of fact, in the first case, the cut of HCO recycled only contains hydrocarbons obtained after the first cracking of the fresh charge, whereas in the second case, it also contains hydrocarbons from the second chamber which were not converted after passing through the two successive reactors and which are therefore particularly resistant to cracking and which "turn around and around" in the unit. In Test No. 1 conducted in accordance with this present invention, the elimination of such components thanks to the partitioned fractionating system notably improves the quality of cracking in the second reaction chamber. Please note that, as a matter of fact, this conversion is at the same time more comprehensive (increase in the conversion rate by 10 points) and more selective (strong decrease in terms of slurry yield, which is a particularly undesirable product, for the benefit of an increase of the yield of desired intermediate products, such as gasolines and GPLs).

Example 2

In this example two tests (Tests Nos. 3 and 4, respectively) were conducted in the same units and under the same operating conditions as Tests 1 and 2, respectively, in Example 1, with the only different that this time, the cut recycled in the second reaction chamber (16) is diesel oil or LCO type cut (with a boiling point range between 200° C. and 380° C.). In Test No. 3 in accordance with this present invention, all LCO obtained through partitioned fractionating of the effluents of the first reaction chamber (1) is injected into the second reaction chamber (16). In the comparative Test No. 4, the recycle rate (ratio between the quantity of LCO recycled in the second reaction chamber compared with the total quantity of LCO produced in the unit) is 0.8. The sane fresh charge as described in Example 1 is used.

For each of the two tests, the properties of the LCO cut recycled in the second reaction chamber were determined. The table below shows the results obtained:

| Properties of the Recycled Cut | Test 3 | Test 4 (Comparative Test) |
|---|---|---|
| Density (at 15° C.) | 0.9522 | 0.9543 |
| Viscosity (at 50° C.) | 2.76 | 2.98 |
| Sulfur Content (% by weight) | 2.59 | 2.71 |
| Molecular Hydrogen Content (% by weight) | 10.10 | 9.79 |

The results above show, in a manner that is complementary to the results of Example, that this present invention bas certain advantages.

Please note that, as a matter of fact, in the Test No. 3 conducted in accordance with this present invention, the quality of the recycle cut is clearly higher than that obtained in the Comparative Test No. 4. In Test No. 3, this cut is lighter, less viscous, leaner in terms of sulphurated impurities; the hydrogen content of the hydrocarbons contained therein is higher. This cut is therefore leaner in terms of heavy hydrocarbons, in particular insofar as the polyaromatic components that are particularly resistant to cracking are concerned.

This example therefore illustrates the fact that, in the procedure in accordance with this present invention, the qualities of the recycle cuts are higher, which contributes to better yields, better selectivity and better quality of the products obtained by cracking such cut in the second reaction chamber 16.

Example 3

In this Example, an experimental catalytic cracking unit like the one shown in FIG. 4 is used with two successive reaction chambers (1; 16), with the first one (1) being a downer, and the second one (16) a riser. The catalyst used is a conventional commercially available zeolite catalyst.

A first test (Test No. 5) is conducted in accordance with this present invention, wherein the effluents from either of these two reaction chambers are directed to one and the same fractionating column (12), which is partitioned in its upper part (40) by a plane vertical wall (37). The fresh charge is injected into the second reaction chamber (16) whereas in the first reaction chamber (1), a cut obtained through separately cracking the effluents of the second chamber (16) is injected.

In addition, a comparable test (Test No. 6) was conducted under the same conditions, except that the partially partitioned fractionating column (12) was replaced by a conventional column in which the effluents of both chambers (1; 16) are combined and cracked in a traditional manner. The fresh charge is injected into the second reaction chamber (16) whereas in the first reaction chamber (1), a cut obtained through the combined cracking of effluents of the two chambers is injected.

In both tests, the cut recycled in the first reaction chamber (1) corresponds to a light gasoline (with a boiling point range between 20° C. and 220° C. In Test No. 5 in accordance with this present invention, all gasoline obtained through partitioned cracking of the effluents of the second reaction chamber (16) is injected into the first reaction chamber (1). In the comparative Test No. 6, the recycle rate (ratio between the quantity of gasoline recycled in the first reaction chamber compared with the total quantity of gasoline produced in the unit) is 0.8.

The fresh charge used is the same as the one used in Example 1, and the operating conditions re the same for both tests, to wit:

Temperature at the outlet of the first reaction chamber (1): 510° C.

Temperature at the outlet of the second reaction chamber (16): 515° C.

C/O ratio in the first reaction chamber (1): 8

C/O ratio in the second reaction chamber (16): 6

Regenerator temperature (23): 690° C.

For each of the two tests, the properties of the gasoline cut recycled in the first reaction chamber (1) were determined. The table below shows the results obtained:

| Properties of the Recycled Cut | Test 5 | Test 6 (Comparative Test) |
|---|---|---|
| Density (at 15° C.) | 0.7130 | 0.7289 |
| Sulfur Content (% by weight) | 0.063 | 2.71 |
| Molecular Hydrogen Content (% by weight) | 14.30 | 13.77 |
| Aromatic Component Content (% by weight) | 16.0 | 17.5 |

Again, please note that in Test No. 5 in accordance with this present invention, the quality of the recycle cut is clearly higher than that obtained in the Comparative Test No. 6. As a matter of fact, in Test No. 5, this cut is lighter, leaner in terms of sulphurated impurities; its content of molecular hydrogen is higher, and its content of aromatic hydrocarbons is lower. Cracking of such a cut in the first reaction chamber not only produces higher yields, but also better qualities of the cracking products.

Generally speaking, the above examples perfectly illustrate some of the numerous advantages of the invention presented herein. In particular, they show that this present invention makes it possible to optimally recycle certain cuts of hydrocarbons obtained through a first stage of cracking the fresh charge, which makes it possible to substantially increase the total conversion yield of such charge with increased selectivity in favor of the specific products desired.

What is claimed is:

1. A procedure for fluidized bed cracking of a hydrocarbon charge in which cooling particles, which may optionally be catalytic, circulate in two successive reaction chambers (1; 16), in each of which they are put into contact with at least one cut of hydrocarbons, and the reaction effluents from each of said chambers are directed towards one and the same fractionating unit, characterized in that the effluents from each of the reaction chambers (1; 16) are cracked in part separately in the same partially partitioned fractionating column (12) and in that at least one cut (13, 44*a*) obtained through separately cracking the effluents of one of the two reaction chambers (1; 16) is as a whole or in part, reinjected into the other chamber.

2. A procedure in accordance with claim 1, characterized in that the hydrocarbons injected into the first reaction chamber (1) remain therein for a shorter period of time that the hydrocarbons injected into the second reaction chamber (16).

3. A procedure in accordance with claim 1, characterized in that the hydrocarbons injected into the first reaction chamber (1) remain therein for between 0.05 and 5 seconds, preferably between 0.1 and 1 seconds.

4. A process in accordance with claim 3, wherein the hydrocarbons injected into the first reaction chamber (1) remain therein for between 0.1 and 1 second.

5. A procedure in accordance with claim 1, characterized in that the hydrocarbons injected into the second reaction chamber (16) remain therein for between 0.1 and 10 seconds, preferably between 0.4 and 5 seconds.

6. A process in accordance with claim 5, wherein the hydrocarbons injected into d second reaction chamber (16) remain therein for between 0.4 and 5 seconds.

7. A procedure in accordance with claim 1, characterized in that the charge and the parts flow in an essentially downward direction in the first reaction chamber (1).

8. A procedure in accordance with any one of the preceding claims, characterized in that the charge and the parts flow in an essentially upward direction in the second reaction chamber (16).

9. A procedure in accordance with claim 1, characterized in that, in said partially partitioned fractionating column (12), the heaviest effluents from each of the two reaction chambers are cracked separately, whereas the lightest effluents are combined.

10. A procedure in accordance with claim 9, characterized in that said cut (13) obtained through separately cracking the effluents of one of the reaction chambers and which, as a whole or in part, reinjected into the other chamber contains slurry and/or a heavy distillate of the type HCO and/or a cut of the type diesel oil, such as LCO.

11. A process in accordance with claim 10, wherein said diesel oil is LCO.

12. A procedure in accordance with claim 9, characterized in that at least one cut (13) obtained through separately cracking the heaviest effluents of the first reaction chamber (1) is, as a whole or in part, reinjected into the second reaction chamber (16).

13. A procedure in accordance with claim 1, characterized in that, in said partially partitioned fractionating column (12), the lightest effluents from each of the two reaction chambers are cracked separately, whereas the heaviest effluents are combined.

14. A procedure in accordance with claim 13, characterized in that said cut (44*a*) obtained through separately cracking the effluent of one of the reaction chambers and which, as a whole or in part, reinjected into the other chamber contains gasoline.

15. A procedure in accordance with claim 10, characterized in that at least one cut (44*a*) obtained through separately cracking the lightest effluents of the second reaction chamber (16) is, as a whole or in part, reinjected into the first reaction chamber (1).

16. A procedure in accordance with claim 1, characterized in that said cut (13; 44*a*) obtained through separately cracking the effluents from one of the reaction chambers and which is, as a whole or in part, reinjected into the other chamber is, prior to such to reinjection, combined with other hydrocarbon cuts.

17. A procedure in accordance with claim 1, characterized in that said cut (13; 44*a*) obtained through separately cracking the effluent from one of the reaction chambers and which is, as a whole or in part, reinjected into the other chamber is, prior to such reinjection, subject to one or more intermediate treatments.

18. A procedure in accordance with claim 17, characterized in that said intermediate treatment includes a hydrotreatment, e.g. hydrogenation, hydrodearomatization, hydrodesulfuration, hydrodeazotation.

19. A process in accordance with claim 18, wherein said hydrotreatment is hydrogenation.

20. A procedure in accordance with claim 1, characterized in that upstream from the second reaction chamber (16), in addition to the particles from the first reaction chamber (1) an auxiliary quantity of particles from the regenerator (23) are introduced.

21. A process accordance with claim 1, wherein the cooling particles are catalytic.

* * * * *